US005413183A

United States Patent [19]

England

[11] Patent Number: 5,413,183

[45] Date of Patent: May 9, 1995

[54] SPHERICAL REAMING BIT

[76] Inventor: J. Richard England, 1021 Dublin Street, Sudbury, Ontario, Canada, P3A 1R5

[21] Appl. No.: 62,174

[22] Filed: May 17, 1993

[51] Int. Cl.[6] ..... E21B 10/22

[52] U.S. Cl. ..... 175/53; 175/406

[58] Field of Search ..... 175/53, 406; 299/92

[56] References Cited

U.S. PATENT DOCUMENTS 4,241,799 12/1980 Going, III ..... 175/53 X
4,244,433 1/1981 Kellner ..... 175/53 X
4,399,879 8/1983 Liljekvist et al. ..... 175/53 X
4,484,783 11/1984 Emmerich ..... 299/92 X

*Primary Examiner*—William P. Neuder
*Attorney, Agent, or Firm*—McFadden, Fincham

[57] ABSTRACT

A reamer bit for reaming in earth formations. In one embodiment, the reaming bit provides spherical reaming faces with replaceable cutting bit holders. The holders include cutting bits. The spherical reaming faces are not appreciably susceptible to drag during a reaming procedure and premature wear of the faces is alleviated by the provision of bits. The overall result is a substantially improved apparatus for reaming which assists in cost reductions for the process.

10 Claims, 3 Drawing Sheets

SPHERICAL REAMING BIT

FIELD OF THE INVENTION

The present invention relates to a spherical reaming bit and more particularly, the invention relates to an improved reaming bit for use in reaming.

BACKGROUND OF THE INVENTION

Reaming arrangements have been proposed in the art previously. Generally speaking, reamers provide particular use in enlarging pilot holes previously drilled. The reaming bit is pulled through a drilled pilot hole rather than pushed and accordingly, a substantial amount of friction is received by the reaming faces and particularly at the cutting bits or buttons thereof.

During a reaming procedure when employing conventional reamer bits such as those of a cylindrical geometry, the friction experienced by the reaming face is not regular or uniform at all positions thereover. As a natural consequence, irregular wear occurs on the reaming face with the possibility of having completely "bald" areas on the face, completely devoid of cutting inserts, while other areas are unaffected. A further difficulty with present arrangements is that the same generally wear out to the point of being useless far too quickly.

In addition to the above, the present design of reaming bits in which the individual members of the bit are cropped together, provide a large number of areas between the individual members within which debris may become trapped. The result is that the individual members of the bit jam and subsequently are dragged within the formation. Such conditions eventually destroy the individual members of the bit and eventually the entire bit.

In a related matter, the reaming faces, when the same become worn or the cutting bits dull, etc., require replacement which poses a fairly involved procedure in terms of time. Generally, the bearings of the reaming faces are associated with the interior of the faces themselves. This is inconvenient when exchange or replacement is required. Since the overall reaming arrangement may present no further utility for reasons outlined above, the bearing system associated therewith may be in perfect working order, but must be discarded with the spent arrangement. This clearly has negative ramifications in terms of cost and productivity and is an unnecessary waste.

SUMMARY OF THE INVENTION

In accordance with one aspect of the present invention, there is provided an improved reaming bit for use in reaming which overcomes the difficulties attributed to prior arrangements.

In accordance with a further aspect of the present invention, there is provided a reamer bit for reaming an opening in an earth formation, the bit including a stem and at least one shaft for connection with drive means comprising:

- a pair of reaming bodies rotatably mounted to the stem, each body of the pair having a plurality of exterior openings for receiving cutting bit means;
- cutting bit means for cutting into an earth formation; and
- holder means for the cutting bit means releasably engageable within the openings.

The reaming faces advantageously comprise semi-circular faces and may be removed from the stem and replaced with a differently sized faces. This advantage results from the fact that the bearings of the arrangement remains associated with the stem, this being common for all reaming face sizes. A fastener is included to releasably retain the face on the stem; a further advantage results from this arrangement exemplified by expedient interchange.

In another aspect of the present invention there is provided a reamer bit for reaming in earth formations, the reaming bit comprising:

- a stem having means for communicating with a fluid source;
- shaft means extending from the stem for connecting with a drive source;
- a pair of semi-circular reaming faces, each member of the pair being rotatably mounted to the stem and together forming a substantially circular reaming face;
- the faces each having a plurality of openings for receiving cutting bit means;
- cutting bit means; and
- holder means for the cutting bit means releasably engageable within the openings.

A significant feature of the invention is the provision of removable and replaceable cutting bits for mounting within the reaming or cutting faces. Holders for the cutting bits are both inexpensive and easily replaceable and avoid the wastage issue of the reaming face assembly set forth herein previously.

In accordance with a further aspect of the present invention there is provided a drill bit for drilling in earth formations, said drill bit having a bit body and a plurality of apertures therein adapted for receiving cutting bits therein, the improvement comprising: a plurality of holder members each for releasably receiving and retaining a cutting bit therein, each holder being releasably engageable within one aperture of the apertures.

As an ancillary feature of the invention, a double shaft may be provided, i.e. a shaft associated with each end of the stem. This provision allows a user to easily recover a inoperable unit or one which has become lodged and immobile; this feature is attractive since, conventionally, reaming units were irretrievable due to the absence of this feature.

Typically, many ore deposits having varying degrees of ore concentration have been abandoned due to the cost of replacing bits, reamers and other equipment or due to the extent of drilling to reach a deposit location. The present invention makes it more feasible to reach such deposits since the cost of the overall procedure is reduced.

Further advantages of the present invention include the fact that reaming is possible from any direction; the faces, due to the semi-circular shape, effectively clear debris away from the faces such that jamming from debris collection is avoided and the fact that the arrangement may be employed in push/pull reaming.

Singly or in combination, the advantages associated with the present invention have a dramatic effect on drilling expenditures on a cost per foot basis and accordingly, the present invention facilitates cost effective access to previously abandoned areas or areas having difficult ground conditions.

Having thus generally described the invention, reference will now be made to the accompanying drawings illustrating preferred embodiments.

DETAILED DESCRIPTION OF THE PREFERRED EMBODIMENT

Figure 1:
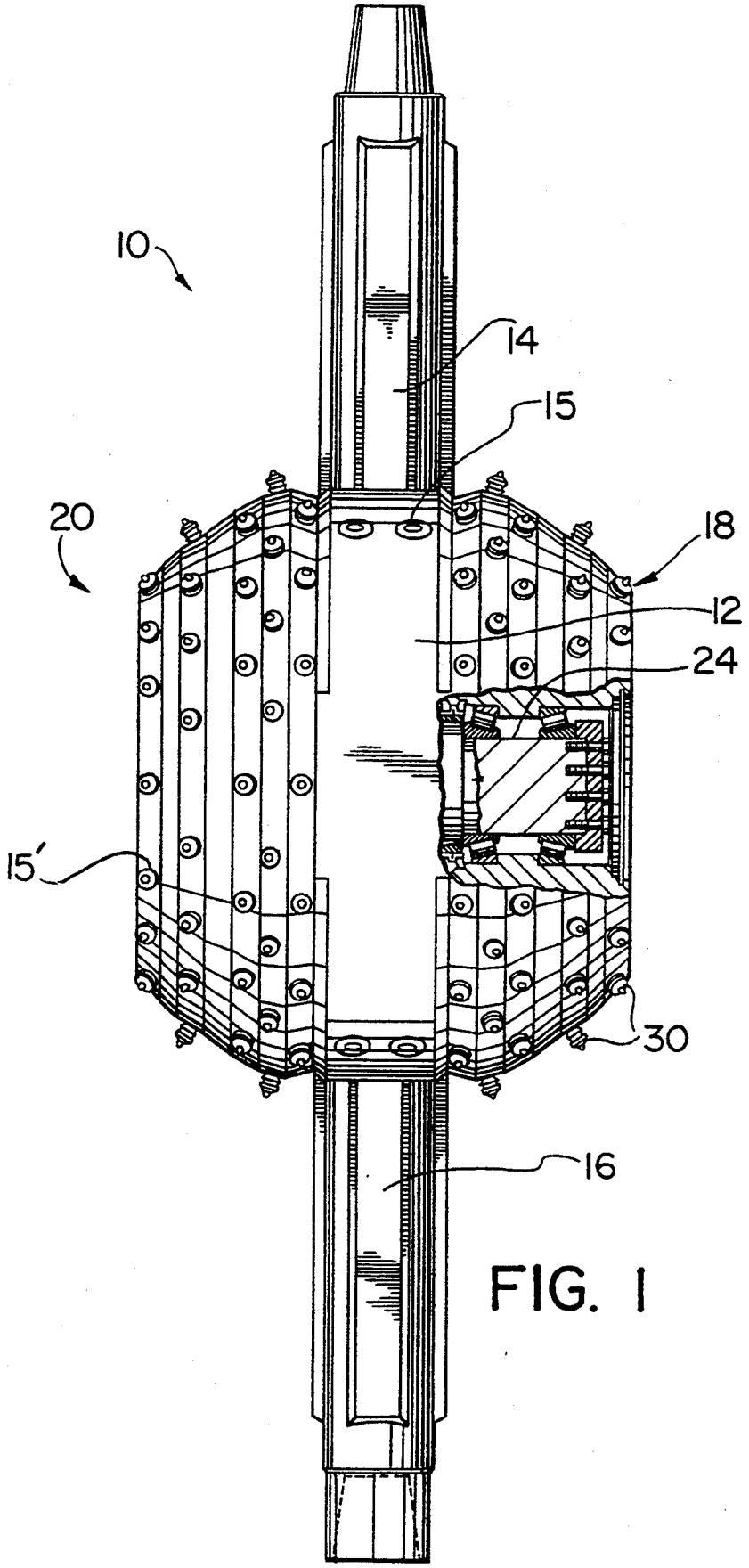
FIG. 1 is a front elevational view, partially cutaway, of an embodiment of the present invention.
Figure 2:
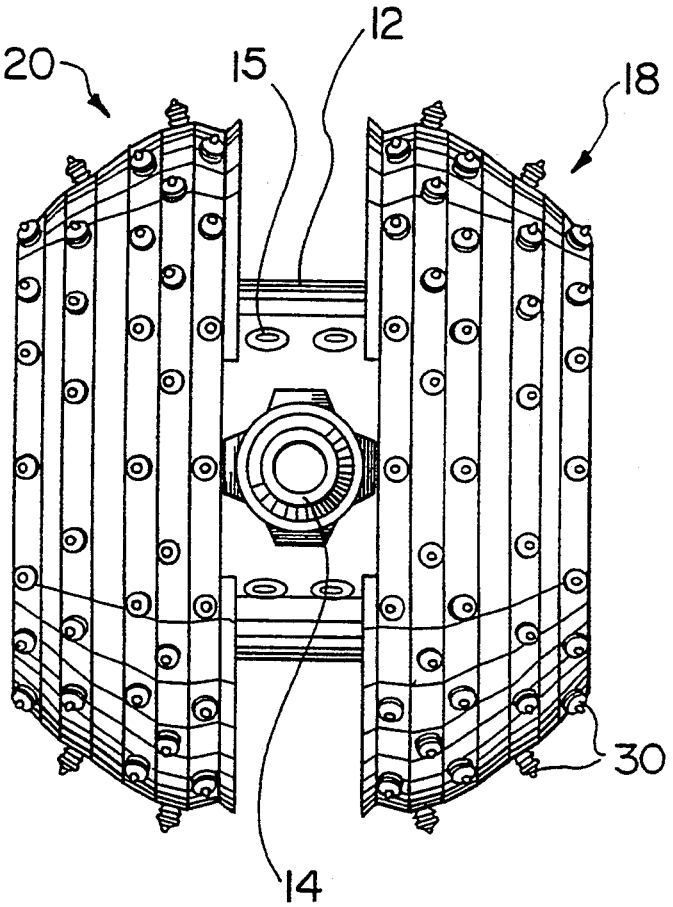
FIG. 2 is a top plan of FIG. 1.

In the drawings, reference numeral 10 denotes the overall reamer arrangement. The bit includes a stem 12 from which projects a shaft 14. A second diametrically opposed shaft 16 may additionally be provided. Generally at the juncture of shaft 14 and stem 12 there is provided a plurality of openings 15 providing fluid access into channels (not shown) within bit 10 for cleaning or debris removal as is known in this art. The shafts 14 or 16 are configured to permit connection with a drill rod (not shown) which effects rotation of the bit about a first axis coincident with the shafts. The cutting faces freely rotate about an axis orthogonal to the first axis.

In a first embodiment, the cutting faces denoted by numerals 18 and 20, comprise generally semi-circular members rotatably mounted to stem 12 and specifically to lateral bearing members 24 and 28, respectively 28 being obscured from view in FIG. 1. A plurality of spaced apart cutting bits, generally denoted by numeral 30 extend outwardly from each cutting face 18 and 20 discussed hereafter.

Figure 3:
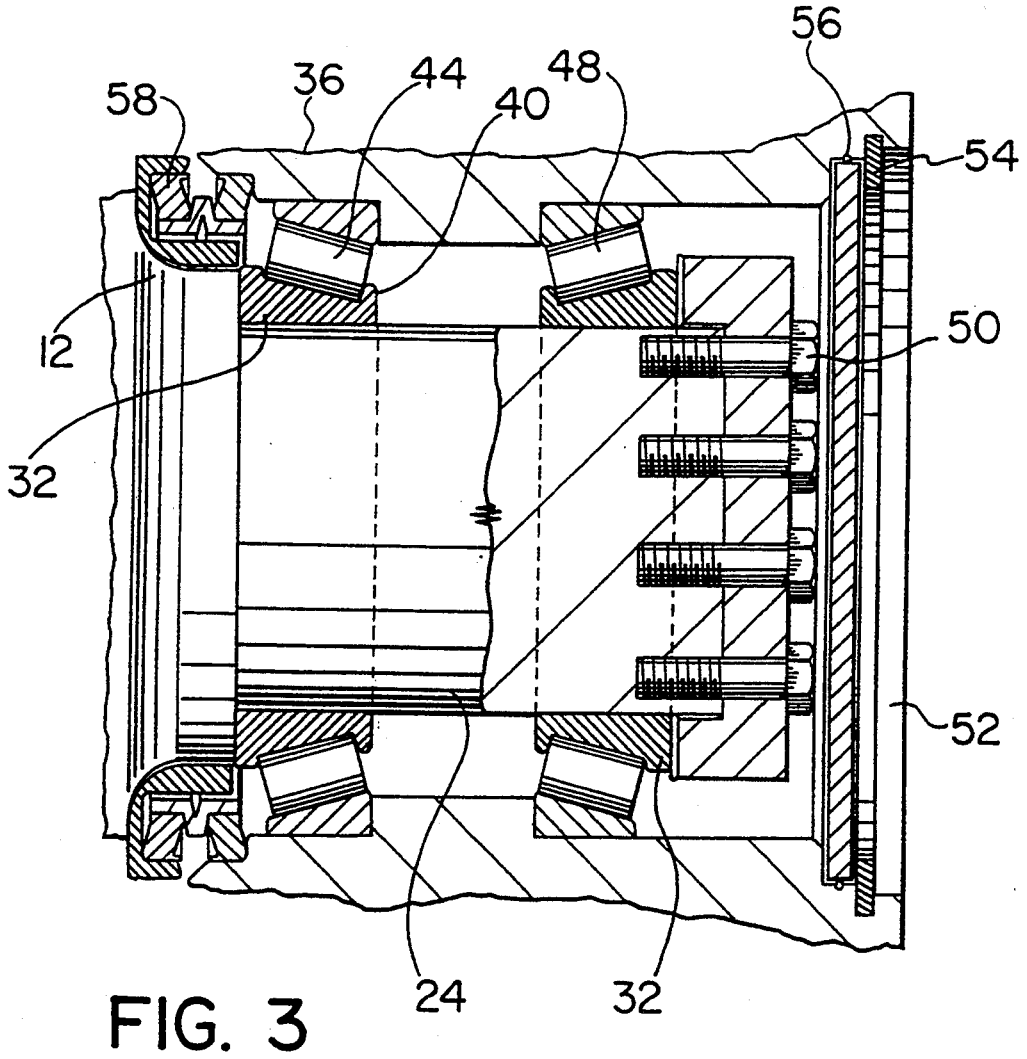
FIG. 3 is an enlarged view of the bearing arrangement shown in the cutaway portion of FIG. 1.

FIG. 3 illustrates an enlarged view of the bearing arrangement and the relationship between the cutting faces 18 and 20 and the lateral bearing members. Each lateral bearing member 24 and 28, 24 shown only in FIG. 3, includes spaced annular bearing retainers 32 which each provide shoulders 36 and 40 for slidably retaining bearings 44 and 48.

Each cutting face 18 and 20 is retained to a respective lateral member 24 or 28 by bolts 50 securing a face thereto. A cover plate 52 covers the bolt heads and is releasably retained to a lateral bearing element 24 or 28 by a snap ring fastener 54. Suitable dust or debris seals 56 and 58 are provided to prevent ingress of moisture, dust and other debris within the bearing.

The size of the lateral bearing elements 24 and 28 and the bearings 44,48 thereof are preferably the same size for a variety of differently sized cutting faces 18 and 20. This feature has the advantage of permitting quick interchange when a larger reamed opening is required.

Figure 4:
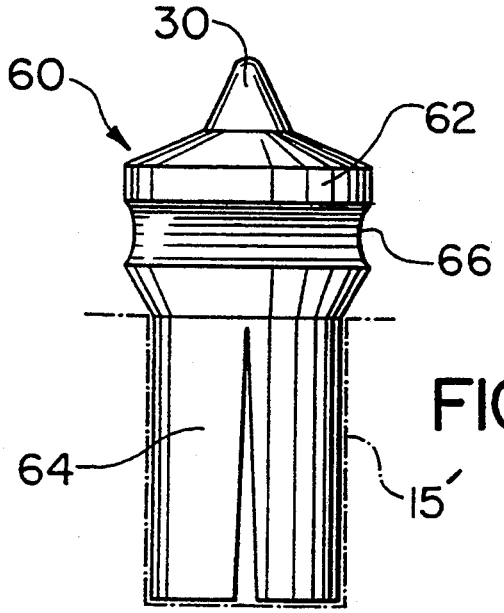
FIG. 4 is an enlarged sectional view of one embodiment for the holder arrangement.

Referring now to FIG. 4, there is illustrated an enlarged sectional view of the cutting bit and holder.

Numeral 60 denotes the holder for holding cutting bit 30. The holder, as shown in the example, provides a main body portion 62 having an integral cutting bit 30 projecting therefrom. A resilient member 64 e.g. a leaf spring is provided on body 62 to facilitate frictional retention of holder 60 in openings 15' of faces 18 and 20. Cutting bit 30 may comprise a Kannenmetal TM pick, known to those skilled in the drilling art.

The cutting bit holders 60 may be removed and replaced when the cutting bit 30 is no longer useful. To this end, a peripheral groove 66 may be provided on body 62 to permit easy removal with a suitable tool (not shown).

As an attendant feature of the removable holder aspect of the invention, holders with differently sized bits or bits having a different metal content may be used with the same faces 18 and 20. Selection will depend on the type of formation to be reamed.

As an alternate embodiment, the semi-circular cutting faces may be paired. In one example, the reaming bit may include a larger diameter pair of faces in spaced relation within which is disposed a pair having a smaller diameter.

Although embodiments of the invention have been described above, it is not limited thereto and it will be apparent to those skilled in the art that numerous modifications form part of the present invention insofar as they do not depart from the spirit, nature and scope of the claimed and described invention.

I claim:

1. A reamer bit for reaming an opening in an earth formation, said bit including a stem and at least one shaft for connection with drive means comprising:

a pair of semi-circular reaming bodies rotatably mounted to said stem, each body of said pair having a plurality of exterior openings for receiving cutting bit means;

cutting bit means for cutting into an earth formation; and holder means for said cutting bit means releasably engageable within said openings.

2. The reamer bit as set forth in claim 1, wherein said semi-circular reaming body is releasably mounted to said stem.

3. The reamer bit as set forth in claim 2, wherein said stem includes bearing means, each said semi-circular body including guide means for guided rotatable movement on said bearing means.

4. The reamer bit as set forth in claim 1, wherein said cutting bit means comprise a plurality of picks.

5. The reamer bit as set forth in claim 4, wherein said picks comprise metal picks.

6. A reamer bit for reaming in earth formations, said reaming bit comprising:

a stem having means for communicating with a fluid source;

shaft means extending from said stem for connecting with a drive source;

a pair of semi-circular reaming faces, each member of said pair being rotatably mounted to said stem and together forming a substantially circular reaming face;

said faces each having a plurality of openings for receiving cutting bit means;

cutting bit means; and holder means for said cutting bit means releasably engageable within said openings.

7. The reamer bit as set forth in claim 6, wherein said reaming faces are removably mounted to said stem.

8. The reamer bit as set forth in claim 6, wherein said shaft means includes two shaft members in opposition.

9. The reamer bit as set forth in claim 6, wherein said holder means each include a resilient member for retaining each said holder means in an opening of said openings.

10. The reamer bit as set forth in claim 9, wherein said bits comprise metal picks.

* * * * *